US006726528B2

(12) United States Patent
Barbour

(10) Patent No.: US 6,726,528 B2
(45) Date of Patent: Apr. 27, 2004

(54) POLISHING PAD WITH OPTICAL SENSOR

(75) Inventor: Greg Barbour, San Luis Obispo, CA (US)

(73) Assignee: Strasbaugh, San Luis Obispo, CA (US)

( * ) Notice: Subject to any disclaimer, the term of this patent is extended or adjusted under 35 U.S.C. 154(b) by 0 days.

(21) Appl. No.: 10/146,494

(22) Filed: May 14, 2002

(65) Prior Publication Data

US 2003/0216107 A1 Nov. 20, 2003

(51) Int. Cl.[7] ..... B24B 49/00

(52) U.S. Cl. ..... 451/6; 451/10; 451/11; 451/41; 451/285; 451/287; 451/533

(58) Field of Search ..... 451/6, 9, 10, 11, 451/41, 285, 287, 526, 530, 533–534

(56) References Cited

U.S. PATENT DOCUMENTS

| | | | | |
|---|---|---|---|---|
| 5,081,796 A | | 1/1992 | Schultz | 51/165.74 |
| 5,433,651 A | | 7/1995 | Lustig et al. | 451/6 |
| 5,838,447 A | | 11/1998 | Hiyama et al. | 356/381 |
| 5,893,796 A | | 4/1999 | Birang et al. | 451/526 |
| 5,949,927 A | | 9/1999 | Tang | 385/12 |
| 6,045,439 A | | 4/2000 | Birang et al. | 451/526 |
| 6,068,539 A | | 5/2000 | Bajaj et al. | 451/6 |
| 6,106,662 A | | 8/2000 | Bibby, Jr. et al. | 156/345 |
| 6,146,242 A | | 11/2000 | Truer et al. | 451/6 |
| 6,190,234 B1 | | 2/2001 | Swedek et al. | 451/6 |
| 6,257,953 B1 | * | 7/2001 | Gitis et al. | 451/5 |
| 6,322,422 B1 | * | 11/2001 | Satou | 451/8 |
| 6,447,369 B1 | * | 9/2002 | Moore | 451/6 |
| 6,454,630 B1 | * | 9/2002 | Tolles | 451/6 |
| 6,485,354 B1 | * | 11/2002 | Wolf | 451/6 |

FOREIGN PATENT DOCUMENTS

| | | | |
|---|---|---|---|
| JP | 3-234467 | 10/1991 | B24B/37/04 |

OTHER PUBLICATIONS

PCT International Search Report dated Jan. 24, 2002.

* cited by examiner

*Primary Examiner*—Eileen P. Morgan
(74) *Attorney, Agent, or Firm*—K. David Crockett, Esq.; Crockett & Crockett

(57) ABSTRACT

A polishing pad having an optical assembly that does not cause excess wear on a wafer workpiece. The optical assembly is disposed within the pad such that it may move in response to forces applied to the optical assembly.

15 Claims, 4 Drawing Sheets

6
15
7
1
16
6
4
5
8
4
5
14
3
13
13
14
12
9
10
11
2
17
18

POLISHING PAD WITH OPTICAL SENSOR

FIELD OF THE INVENTIONS

The present invention relates to semiconductor wafer processing and specifically to disposable polishing pads having a sensor disposed within the pad.

BACKGROUND OF THE INVENTIONS

Most electronic chips are built by layering different materials on top of each other, with the layers disposed on a semiconductor wafer (typically silicon). As each new layer is added, a polishing or grinding step is often needed to remove excess layer material, to planarized the wafer (make it very flat), or to accomplish other goals. The polishing process is often referred to as chemical mechanical planarization (CMP). When a plurality of layers is required then a large number of CMP steps may be necessary. In addition, the chip building process often requires that very thin layers of material be removed evenly from a wafer. To ensure that the correct amount of material is removed at each CMP step, some means for determining when to end polishing is needed.

One such means is to use an optical sensor that senses how much layer material has been removed or senses when a new layer has been reached. However, using an optical sensor can be difficult since the sensor is disposed very near the wafer surface. In addition, a caustic slurry used during the CMP process may damage the sensor. Nevertheless, a number of ways exist to deploy the optical sensor such that it can take the necessary measurements of the wafer.

A number of designs for a window installed in a polishing pad are shown in Birang et al., *Forming a Transparent Window in a Polishing Pad for a Chemical Mechanical Polishing Apparatus*, U.S. Pat. No. 5,893,796 (Apr. 13, 1999). The wafer to be polished is on top of the polishing pad, and the polishing pad rests upon a rigid platen so that the polishing occurs on the lower surface of the wafer. That surface is monitored during the polishing process by an interferometer that is located below the rigid platen. The interferometer directs a laser beam upward, and in order for it to reach the lower surface of the wafer, it must pass through an aperture in the platen and then continue upward through the polishing pad. To prevent the accumulation of slurry above the aperture in the platen, a window is provided in the polishing pad. Regardless of how the window is formed, it is clear that the interferometer sensor is always located below the platen and is never located in the polishing pad.

Another method is shown in Schultz, *Method and Apparatus for Mechanical Planarization and Endpoint Detection of a Semiconductor Wafer*, U.S. Pat. No. 5,081,796 (Jan. 21, 1992). Schultz describes a method in which, after partial polishing, the wafer is moved to a position in which part of the wafer overhangs the edge of the platen. The wear on this overhanging part is measured by interferometry to determine whether the polishing process should be continued.

Optical sensors disposed within polishing pads are capable of performing the required layer analysis with high efficiency. It is possible to increase the uniformity of polishing of these pads by providing an optical assembly that is capable of moving up and down within the pad as the pad wears.

SUMMARY

The methods and devices described below provide a sensor assembly disposed within a polishing pad such that, regardless of relative hardness of the optical assembly material, the assembly and pad together provide for even wear of the wafer. A sensor port or hole is provided in the upper layer of the pad and a larger hole, disposed under the sensor port, is provided in the lower pad layer. The optical assembly is provided with a flexible flange sized and proportioned to be disposed within the larger hole and the flange is glued to the upper pad. In addition, the bottom of the optical assembly is thin enough to leave a space between the bottom of the optical assembly and the bottom of the pad. Thus, the entire optical assembly is suspended from the polishing pad upper layer, allowing the optical assembly to float with the pad upper surface as the wafer and wafer carrier pass over the optical assembly and as the pad thins over the life of the pad.

DETAILED DESCRIPTION OF THE INVENTIONS

Figure 1:
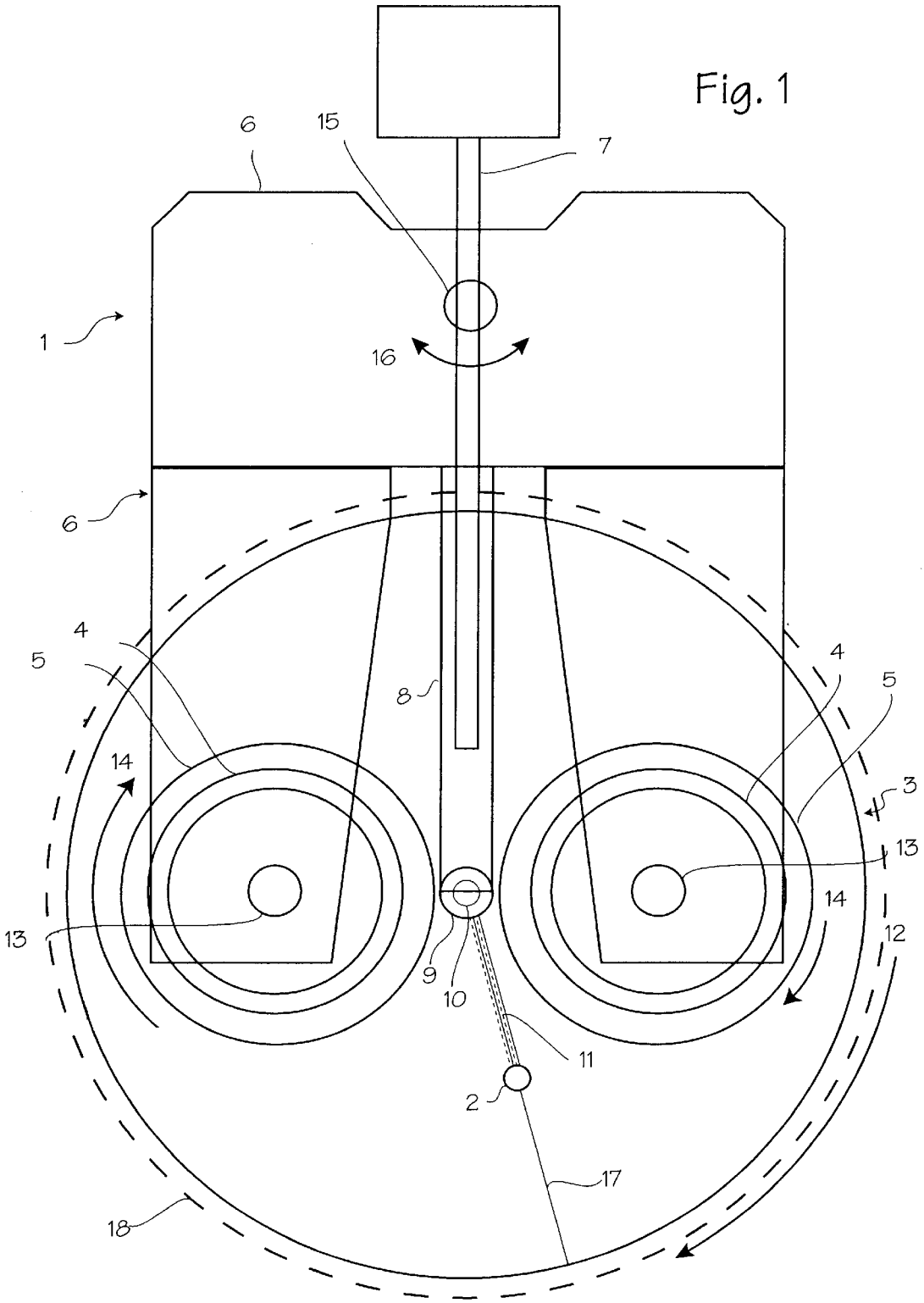
FIG. 1 shows a chemical mechanical planarization machine using a polishing pad having an optical sensor port.

FIG. 1 is an overhead view of a chemical mechanical system 1 with the optical port 2 cut into the polishing pad 3. The wafer 4 (or other workpiece requiring planarization or polishing) is held by the polishing head 5 and suspended over the polishing pad 3 from a translation arm 6. Other systems may use several polishing heads that hold several wafers, and separate translation arms on opposite sides (left and right) of the polishing pad.

The slurry used in the polishing process is injected onto the surface of the polishing pad through slurry injection tube 7. The suspension arm 8 connects to the non-rotating hub 9 that suspends over the electronic assembly hub 10. The electronics assembly hub 10 is removably attached to the polishing pad 3 by means of twist lock, detents, snap rings, screws, threaded segments, or any releasable mating mechanism. The hub 10 is attached to an electrical conducting assembly located within the pad where the hub attaches. The electrical conducting assembly can be either a single contact or a plurality of contacts attached to a thin, electrically conducting ribbon 11, also known as a flex circuit or ribbon cable. The ribbon 11 electrically connects an optical sensor mechanism, located within the optical port 2 and embedded in the pad 3, to the electronics in the electronics hub 10. The ribbon 11 may also comprise individual wires or a thin cable.

The window rotates with the polishing pad, which itself rotates on a process drive table, or platen 18, in the direction of arrow 12. The polishing heads rotate about their respective spindles 13 in the direction of arrows 14. The polishing heads themselves are translated back and forth over the surface of the polishing pad by the translating spindle 15, as indicated by arrow 16. Thus, the optical port 2 passes under the polishing heads while the polishing heads are both rotating and translating, swiping a complex path across the wafer surface on each rotation of the polishing pad/platen assembly.

The optical window 2 and the electrical conducting assembly always remain on the same radial line 17 as the pad rotates. However, the radial line translates in a circular path as pad 3 rotates about the hub 9. The conducting ribbon 11 lies along the radial line 17 and moves with it.

Figure 2:
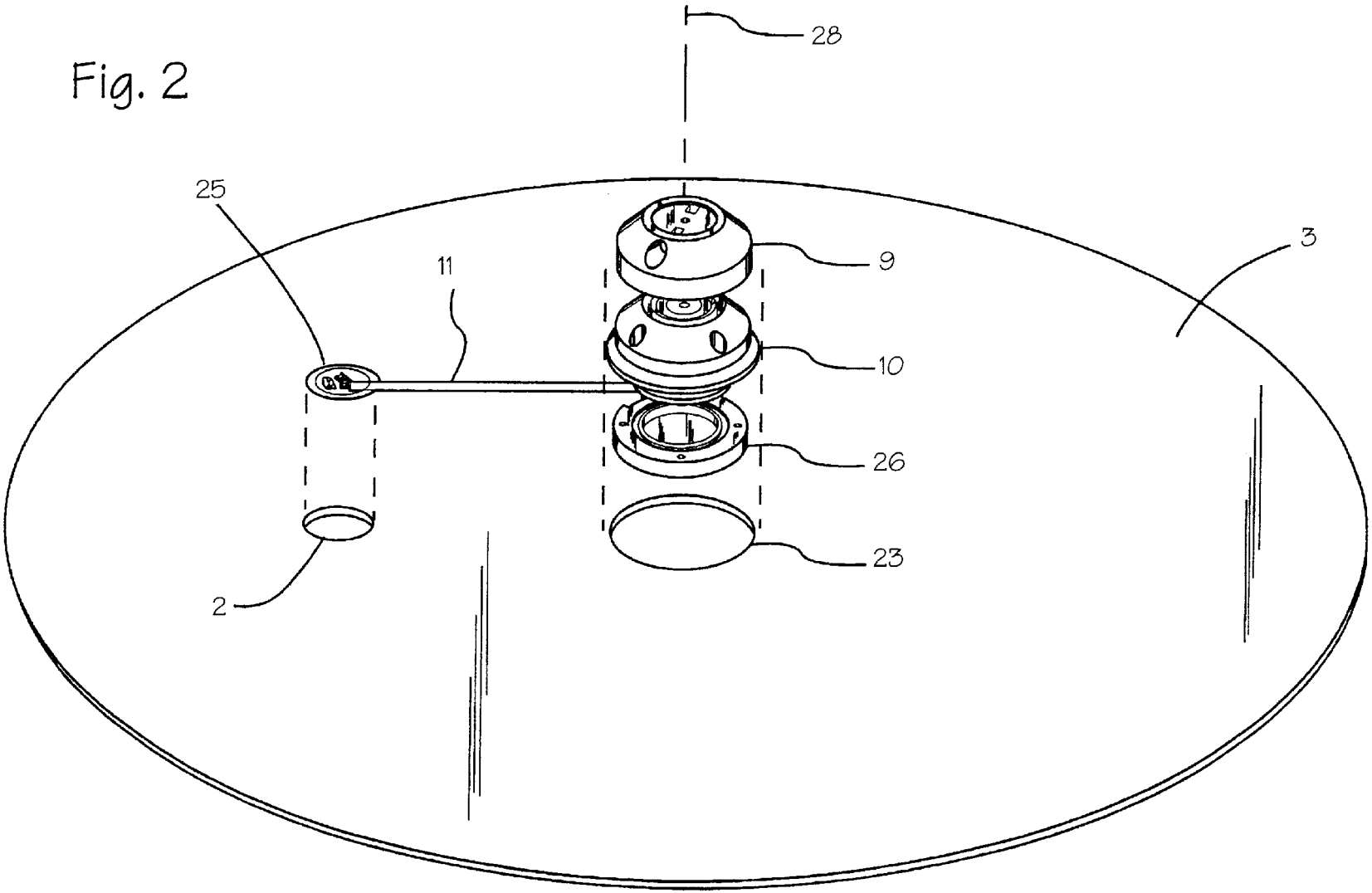
FIG. 2 shows the general arrangement of the elements of the hub and optical assembly as placed in a polishing pad.

As shown in FIG. 2, the polishing pad 3 has a circular shape and a central circular aperture 23. A hole 2 is formed in the polishing pad, and the hole opens upwardly so as to face the surface that is being polished. An optical sensor 24 is placed in the hole 2 and a conductor ribbon 11, which extends from the optical sensor 24 to the central aperture 23, is embedded within the polishing pad 3. The hole may also be a window or port that extends through the entire pad or the hole may be a blind hole.

When the polishing pad 3 is to be used, an electronics hub is inserted from above into the central aperture 23 and secured there by screwing a base 26, which lies below the polishing pad 3, onto a threaded portion of the hub 10. The polishing pad 3 is thus clamped between portions of the hub and portions of the base 26. During the polishing process, the polishing pad 3, the hub 10 and the base 26 rotate together about a central vertical axis 28. The polishing pad may also be provided with a snap ring such that the hub may secured to the polishing pad by snapping the hub into the snap ring.

The non-rotating hub 9 of the polishing machine is located adjacent and above the hub 10. The non-rotating hub 9 is fixed during operation to the suspension arm 8.

Figure 3:
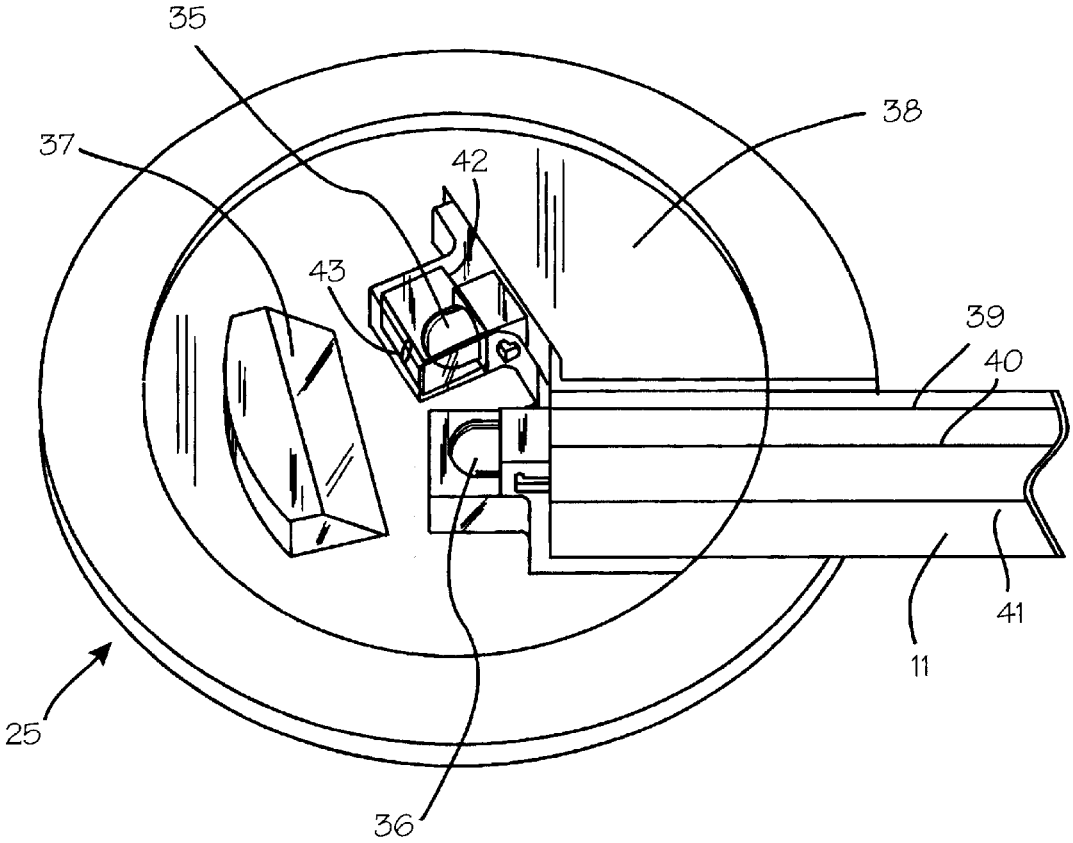
FIG. 3 shows the components of an optical sensor.

FIG. 3 shows the optical sensor 24 in greater detail. The optical sensor 24 includes a light source 35, a detector 36, a reflective surface 37 (which could be a prism, mirror, boundary of a void disposed in the sensor material, or other reflective optical component), and the conductor ribbon 11. The conductor ribbon 11 includes a number of generally parallel conductors laminated together for the purpose of supplying electrical power to the light source 35 and for conducting the electrical output signal of the detector 36 to the central aperture 23. Preferably, the light source 35 and the detector 36 are a matched pair. In general, the light source 35 is a light emitting diode and the detector 36 is a photodiode. The central axis of the beam of light emitted by the light source 35 is directed horizontally initially, but upon reaching the reflective surface 37 the light is redirected upward so as to strike and reflect from the surface that is being polished. The reflected light also is redirected by the reflective surface 37 so that the reflected light falls on the detector 36, which produces an electrical signal in relation to the intensity of the light falling on it. The arrangement shown in FIG. 3 was chosen to minimize the height of the sensor.

Figure 4:
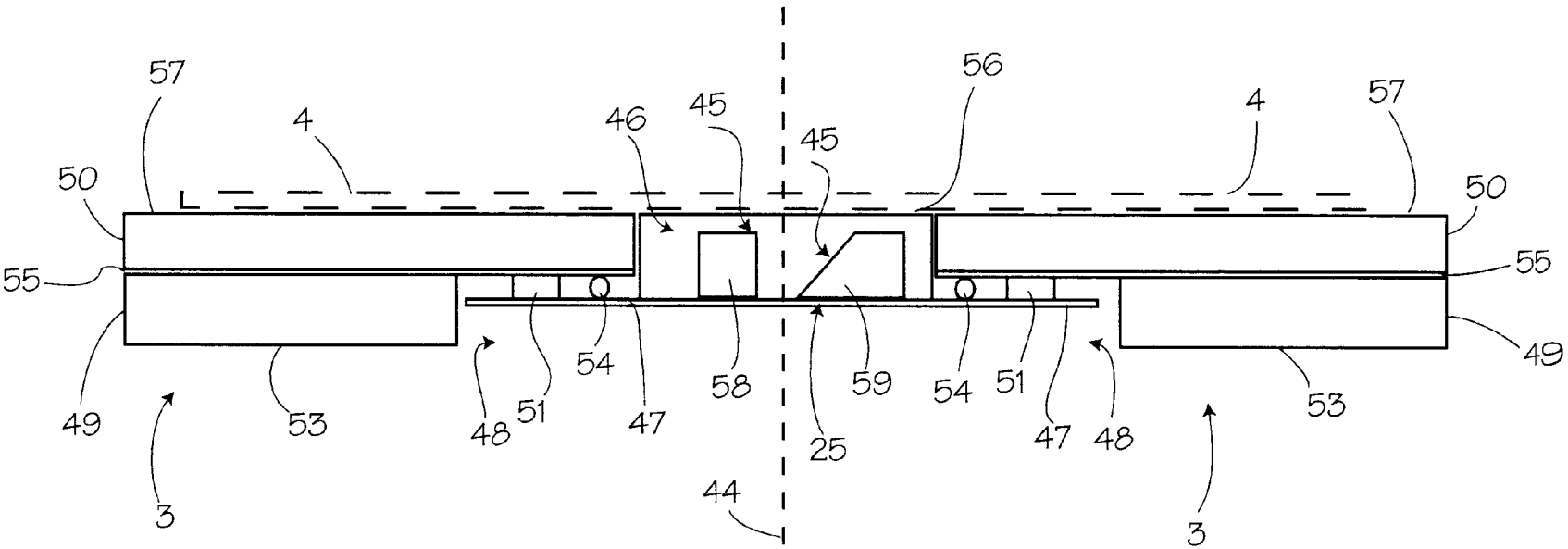
FIG. 4 shows the optical assembly disposed within a polishing pad such that the optical assembly may move up and down within the polishing pad.

The optical components and the end of the conductor ribbon 11 are encapsulated in the form of a thin disk or capsule 38 that is sized to fit snugly within the hole 2 of FIG. 2. Included within the conductor ribbon 11 are three conductors: a power conductor 39, a signal conductor 40, and one or more return or ground conductors 41. In the arrangements of FIGS. 3 and 4 baffles 42, each having a baffle aperture 43, may be used to reduce the amount of non-reflective light reaching the detector 36. Baffles 42 may be added to the light source as well as to the light detector.

FIG. 4 shows an optical assembly 24 disposed within a polishing pad 3 such that the optical assembly may move up and down (along axis 44) within the polishing pad. The optical assembly 24 comprises an optical sensor 45 and a sensor housing, capsule, or puck 46 in which the sensor is disposed. The optical sensor may instead comprise any means for monitoring the progress of polishing (or a means for detecting characteristics of the wafer or other work piece during polishing), such as heat sensor, pH sensors, ultrasound sensors, radio frequency sensors, resistance sensors, or electric field or current sensors. The sensor housing or capsule comprises a thermoplastic resin or other resilient, transparent material having a top surface, a bottom surface, and a thickness.

The optical assembly is provided with an extension (which may be annular) or a flange 47 sized and proportioned to be disposed within a hole 48 cut into the lower layer 49 of polishing pad 3 (the hole in the lower layer 49 of the pad is larger than the hole in the upper layer 50). The flange 47 is connected to the upper pad layer 50 with a bead of glue 51, or is connected by any other suitable means. Thus, the optical assembly 24 is suspended from the upper layer 50 of the pad 3. The top side of the optical assembly may be provided with a beveled edge to further prevent wear on the wafer 4 (shown in phantom) and to provide a smooth surface for wafer override. The optical assembly 24 and the flange 47 are thin enough to leave a space between the bottom of the optical assembly and the bottom surface 53 of the bottom layer 49 of the pad 3.

The flange 47 may be disposed on the optical assembly 24 by a variety of methods. For example, the flange may be molded integrally with the optical assembly 24. In addition, a thin, flexible cylinder or membrane may be disposed on the bottom of the optical assembly or one or more extensions may be attached to the side of the optical assembly. The flange may extend partially around the perimeter of the optical assembly or may extend around the entire perimeter of the optical assembly.

In general, the sensor housing may be conceived of as a capsule having an upper capsule section and a lower capsule section. The lower capsule section is typically larger than the upper capsule section so that the lower capsule section may be suspended from an overhanging lip of an upper hole section in the polishing pad. However, the lower capsule section may be the same size or smaller than the upper capsule section in another embodiment where a small pad or spring is used to keep the capsule co-planar with the top surface of the polishing pad, or where other means of biasing the capsule or connecting it to the pad are used.

A shim or spacer 54 may be disposed between the glue bead 51 and the upper part of the optical assembly (which may be an upper cylinder) and further disposed between the flange and the upper pad layer. The shim prevents glue from entering the space between the upper part of the optical assembly and the shim. Thus, the optical assembly can more easily move up and down within the polishing pad and the regions of the pad closest to the upper part of the optical assembly can deform or deflect independently of the upper part of the optical assembly.

The pad may comprise any polishing pad used in chemical mechanical planarization, grinding, or polishing. The pad may also comprise a pad with multiple layers or a single-layered pad. For example, the pad may comprise a Rodel IC 1000 pad having a lower layer 49, an upper layer 50, and an adhesive layer 55. The upper layer may comprise urethane and the lower layer may comprises a different form of urethane having a different hardness. The upper layer and the lower layer are connected by the adhesive layer 55. In the IC 1000, the upper layer has a hardness of about 50 to 55 Shore D. The optical assembly housing used with this pad comprises a transparent and resilient material (such as a thermoplastic material like Pellethane 2101™ by Dow Chemical) having a hardness of about 90 Shore A (approximately 45 Shore D). Thus, the optical assembly is slightly softer than the upper pad.

Regardless of the number of layers, a hole is disposed in the pad extending from the top surface to the bottom surface to accommodate the optical assembly. The hole may comprise an upper hole section and a lower hole section. The lower hole section may be larger than the upper hole section in order to accommodate the flange (or lower capsule section) within the lower hole section. The upper part of the optical assembly (or the upper capsule section) is disposed within the upper hole section. The lower section of the optical assembly (or the lower capsule) is suspended from an overhanging lip. The upper hole section defines the overhanging lip over the lower hole section.

In another embodiment, the optical assembly 24 may be disposed within the optical port 2 and a small resilient pad or a spring may be disposed on the bottom of the optical assembly. In either case the resilient pad or spring may be attached to the polishing pad, may be attached to the optical assembly with a glue or adhesive, or may be attached to both the polishing pad and attached to the optical assembly. Typically the bottom of the resilient pad or spring will be flush with the bottom surface of the polishing pad. The resilient pad may comprise a pad of urethane or other material of sufficient resiliency to allow the optical assembly to move up and down (along axis 44). The spring may comprise any spring that has a spring constant that allows the optical assembly to move up and down. In either case the resilient pad or spring may be used with or without the flange, glue, shims, or spacers. In addition, the resilient pad or spring may be used with only a single hole in the polishing pad, as opposed to disposing a larger hole in the lower pad.

In use the polishing pad polishes a wafer and the optical assembly monitors the progress of planarization. However, since the optical assembly may move up and down with the upper pad, the top 56 of the optical assembly will remain flush (co-planar) with the upper surface 57 of the pad even if the pad material is worn away faster than the optical assembly material or if a wafer carrier moves across the pad and deforms and compress the pad as it moves. Thus, the wafer will be ground evenly across its entire surface regardless of the relative wear rates of the optical assembly and the polishing pad.

FIG. 4 also shows the features of an optical sensor capable of performing optical measurements on a wafer disposed above the optical assembly. The optical sensor may comprise a variety of optical light sources (such as diodes, lasers, lamps, and other sources of light) and detectors (Such as photodiodes, cameras, charged couple devices, or other means for detecting light). In one embodiment a light emitting diode 58 emits light towards a mirror 59. The mirror may comprise a discrete mirror. However, the optical assembly may be molded to leave a void within the optical assembly. The boundary between the void and the optical assembly is naturally reflective, thus providing a suitable mirror for use with the light emitting diode without providing a discrete mirror within the void. In either case, the light is reflected towards the wafer. The light reflects off of the wafer surface and the reflected light is detected by a second diode disposed next to the light emitting diode. Polishing stops when the characteristics of the reflected light reach the desired values, indicating the endpoint of polishing.

While the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. A polishing pad for use in chemical mechanical planarization of a wafer or other workpiece, said polishing pad characterized by a top surface and a bottom surface and a thickness, said polishing pad having a hole disposed therein, said hole extending substantially completely from the top surface to the bottom surface, said polishing pad further comprising:

a capsule disposed within the hole, said capsule housing a means for detecting characteristics of the wafer or other workpiece during polishing; said capsule having a top surface which is substantially co-planar with the top surface of the pad and a thickness which is less than the thickness of the pad.

2. The polishing pad of claim 1 wherein:

the hole has an upper hole section and a lower hole section, and the lower hole section is larger than the upper hole section; and the capsule is characterized by an upper capsule section and a lower capsule section, said upper capsule section sized and dimensioned to fit within the upper section of the hole, said lower capsule section sized and dimensioned to fit within the lower section of the hole.

3. The polishing pad of claim 1 wherein:

the hole has an upper hole section and a lower hole section, and the lower hole section is larger than the upper hole section; and the upper hole section defines an overhanging lip over the lower hole section, and the capsule is secured to the pad by suspending the capsule from the overhanging lip.

4. The polishing pad of claim 2 wherein:

the upper hole section defines an overhanging lip over the lower hole section, and the capsule is secured to the pad by suspending the lower capsule section from the overhanging lip.

5. A device suitable for polishing wafers, said device comprising:

a polishing pad;

a sensor assembly disposed within the polishing pad;

wherein the sensor assembly is further disposed within the polishing pad such that the sensor assembly may move up and down within the polishing pad.

6. The polishing pad of claim 5 wherein:

the polishing pad is characterized by a thickness; and the sensor assembly has a thickness which is less than the thickness of the polishing pad.

7. A polishing pad comprising:

an upper pad layer and a lower pad layer;

an optical assembly disposed within a hole in the upper and lower pad layers, said optical assembly having a flange, wherein said flange is disposed within a circular void in the lower pad layer and suspended from the pad upper layer such that the optical assembly may move up and down within the polishing pad.

8. The polishing pad of claim 7 further comprising a shim disposed on the flange.

9. The polishing pad of claim 7 wherein the top of the optical assembly has a beveled edge.

10. The polishing pad of claim 8 wherein the top of the optical assembly has a beveled edge.

11. A polishing pad comprising:

an upper pad layer and a lower pad layer, wherein a hole is disposed through the upper and lower pad layers, said hole having an upper hole section disposed in the upper pad layer and a lower hole section disposed in the lower pad layer, wherein the lower hole section is larger than the upper hole section;

a sensor assembly disposed within the hole, said sensor assembly comprising a sensor disposed within a sensor housing, said sensor housing having a top section and a bottom section, wherein an extension is disposed on the bottom section of the sensor housing;

wherein the extension is disposed within the lower hole section and wherein the extension is suspended from the upper pad layer.

12. The pad of claim 11 wherein the extension comprises a flexible membrane disposed on the bottom section of the sensor assembly.

13. The pad of claim 11 wherein the thickness of the sensor assembly and the thickness of the extension is small enough such that the sensor assembly may move up and down within the lower hole section.

14. The pad of claim 11 wherein the sensor assembly comprises an optical sensor.

15. The pad of claim 13 wherein the sensor assembly comprises an optical sensor.

* * * * *